US008943867B2

(12) United States Patent
Nagel

(10) Patent No.: US 8,943,867 B2
(45) Date of Patent: Feb. 3, 2015

(54) EQUIPMENT FOR THE STRAIGHTENING OF DEFORMED ELECTROLYSIS POTSHELLS, IN PARTICULAR FOR ALUMINIUM MOLTEN-BATH ELECTROLYSIS

(75) Inventor: Hardy Nagel, Brühl (DE)

(73) Assignee: Outotec Oyj, Espoo (FI)

( * ) Notice: Subject to any disclaimer, the term of this patent is extended or adjusted under 35 U.S.C. 154(b) by 1080 days.

(21) Appl. No.: 12/990,476

(22) PCT Filed: Apr. 3, 2009

(86) PCT No.: PCT/EP2009/002449

§ 371 (c)(1),
(2), (4) Date: Apr. 15, 2011

(87) PCT Pub. No.: WO2009/132747

PCT Pub. Date: Nov. 5, 2009

(65) Prior Publication Data

US 2011/0203340 A1 Aug. 25, 2011

(30) Foreign Application Priority Data

Apr. 30, 2008 (DE) ..... 10 2008 021 652

(51) Int. Cl.

| | |
|---|---|
| ***B21C 51/00*** | (2006.01) |
| ***C25C 3/08*** | (2006.01) |
| ***B21D 1/10*** | (2006.01) |

(Continued)

(52) U.S. Cl.

CPC ... *C25C 3/08* (2013.01); *B21D 1/10* (2013.01); *C25C 7/06* (2013.01); *Y10S 72/705* (2013.01)

USPC ..... 72/31.03; 72/308; 72/457; 72/705; 269/43

(58) Field of Classification Search

USPC ..... 72/457, 705, 453.01, 31.03, 293, 295, 72/300, 304, 308; 294/207, 67.33; 269/43, 269/45, 902, 143, 249

See application file for complete search history.

(56) References Cited

U.S. PATENT DOCUMENTS 3,421,995 A 1/1969 Morel et al.
5,257,526 A * 11/1993 Teixeria ..... 72/457

(Continued)

OTHER PUBLICATIONS

Gregg, Nicholas, International Search Report for PCT/EP2009/002449, Jul. 15, 2009.

*Primary Examiner* — Edward Tolan
*Assistant Examiner* — Lawrence Averick
(74) *Attorney, Agent, or Firm* — Chernoff, Vilhauer, McClung & Stenzel, LLP

(57) ABSTRACT

A transportable straightening beam which makes it possible to straighten deformed potshell sidewalls of different deformation resistance independently of one another is disclosed for use both with potshell carrying structure and potshell sheeting. The beam can extend between two potshell walls lying opposite one another. Each of its two end regions has a straightening jaw with a downwardly open U-profile-shaped orifice through which the straightening beam can be positioned onto the top side of the potshell sidewalls. Each straightening jaws being arranged with at least one hydraulic straightening ram parallel to the potshell bottom, and the straightening rams lying along a line of action, and such that one straightening jaw lies opposite the other straightening jaw which is carrying out the straightening work on a deformed potshell wall while being firmly braced with the top side of the potshell sidewall and serving as a captively fixed counterbearing.

9 Claims, 5 Drawing Sheets

Figure 1:
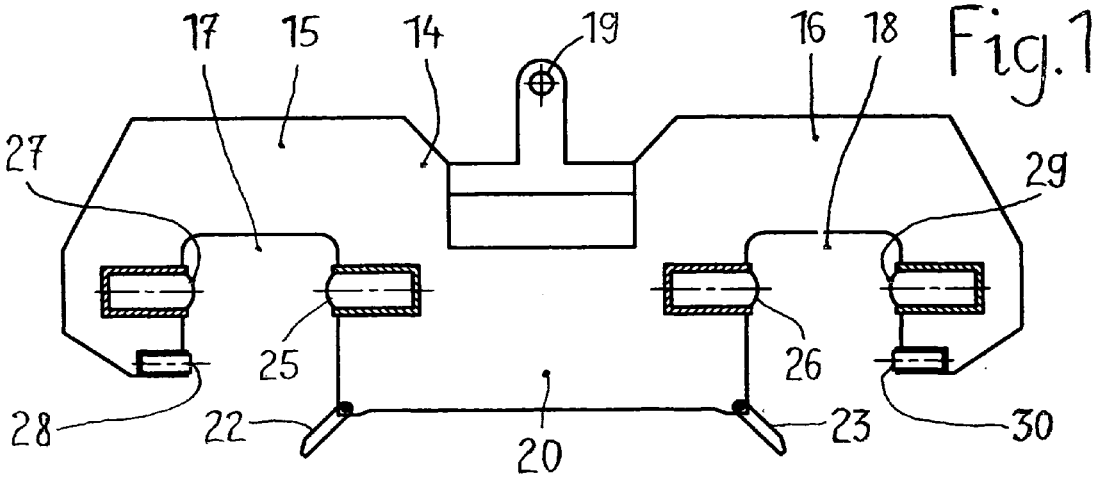

(51) Int. Cl.

| | |
|---|---|
| ***C25C 7/06*** | (2006.01) |
| *B21D 11/00* | (2006.01) |
| *B21J 13/08* | (2006.01) |
| *B21C 1/00* | (2006.01) |
| *B25B 1/24* | (2006.01) |
| *B25B 5/16* | (2006.01) |

(56) References Cited

U.S. PATENT DOCUMENTS 5,819,576 A * 10/1998 Smith, Jr. ..... 72/311
6,474,124 B1 * 11/2002 Leftwich ..... 72/296

* cited by examiner

EQUIPMENT FOR THE STRAIGHTENING OF DEFORMED ELECTROLYSIS POTSHELLS, IN PARTICULAR FOR ALUMINIUM MOLTEN-BATH ELECTROLYSIS

This is a national stage application filed under 35 USC 371 based on International Application No. PCT/EP2009/002449 filed Apr. 3, 2009 and claims priority under 35 USC 119 of German Patent Application No. DE 102008021652.6 filed Apr. 30, 2008.

The invention relates to equipment for the straightening of deformed electrolysis potshells, in particular for aluminium molten-bath electrolysis, with an elongate transportable and displaceable straightening beam which with its length extends over the distance between at least the two opposite long sidewalls of the potshell and which has at each of its two end regions a straightening jaw with a downwardly open U-profile-shaped through orifice, the two straightening jaws being capable of being positioned with their through orifices onto the top side of the potshell sidewalls lying opposite one another, in the working position of the straightening equipment centring unit connected to the straightening beam being seated on the bottom of the potshell to be straightened.

Metallic aluminium is obtained from aluminium oxide by molten-bath electrolysis in electrolytic cells in which anodes in the form of carbon blocks are suspended. The electrolytic cells have rectangular troughs, what are known as the electrolysis potshells, which consist of sheet steel and which are clad with refractory material and are lined in the bottom region with cathode blocks which consist of carbon and which, like the anodes, are provided with metallic current conductors.

The sheeting of the electrolysis potshells is stiffened by means of an external carrying structure, that is to say the potshell bottom and the potshell sidewalls have sturdy webs which are spaced apart from one another on the outside and which, in the case of the potshell sidewalls, are arranged so as to lie approximately vertically. The carrying structure and the sheeting of the electroylis potshells form a unit.

At the end of a furnace trip of an electrolysis cell, it is often necessary to establish that, in particular, the long sidewalls of the electrolysis potshells have been deformed to a greater or lesser extent due to the thermal and mechanical load, even though these are stiffened by means of the carrying structure. The deformation of an electrolysis potshell is mostly where one or more of the potshell sidewalls, which originally stand with their inner walls vertical, has or have been pressed obliquely outwards in the upper region by the metallic electrolysis bath and as a result of thermomechanical expansions. The electrolysis potshells, therefore have to be straightened mechanically before being realigned and before a new furnace trip.

For straightening purposes, devices have been used, with a double-acting hydraulic cylinder which acts in each case on the top side of two potshell sidewalls lying opposite one another. When the hydraulic cylinder is contracted with the intention of bringing an outwardly bulged place on a potshell sidewall into its original place or shape, the hydraulic cylinder is supported on the opposite potshell sidewall. The result of this is that the opposite potshell sidewall is undesirably deformed, in the most unfavourable instance a correctly vertical potshell wall is pulled or pressed askew during the straightening of a deformed potshell wall, because the straightening force dependent on the deformation resistance and degree of deformation is different for the two potshell sidewalls lying opposite one another. Such a repair of an electrolytic cell is unsatisfactory and takes up a lot of time during which the cell cannot be used to obtain aluminium.

In a leaflet of the company Almeq Norway AS, a machine or equipment was proposed, which provided for the straightening of deformed electrolysis potshells. This equipment operates with a straightening beam on the ends of which straightening jaws are movable back and forth, which are mounted and guided in the manner of slides and which can be placed in the same way as large open-ended spanners, with downwardly open through-orifices in the manner of an open-ended spanner, onto the top side of two potshell sidewalls lying opposite one another. In this case, by the straightening jaws being displaced by means of hydraulic cylinders, the straightening force is to be transmitted from the respective straightening jaw to the potshell sidewall. The spanner opening of the straightening jaws, which is coordinated with the cross section of the carrying-structure webs, to be straightened, of the potshell to be straightened, is in this case relatively large and is invariable. When one potshell wall is being straightened in that the straightening force amounting to many tons is applied to one straightening jaw, the opposite straightening jaw, with its constant spanner opening, cannot be retained in an operationally reliable way on the opposite potshell wall, in particular not on the vertically lying potshell carrying-structure webs, especially if these taper upwards in the form of an acute-angled triangle, so that, when the straightening work is being carried out on one potshell sidewall, the other straightening jaw can slip off from the other potshell wall as a result of the occurrence of a tilting moment and cannot be supported reliably there.

The object on which the invention is based is to provide, for the straightening of deformed electrolysis potshells, operationally reliable equipment which makes it possible to straighten deformed potshell sidewalls independently of one another, in particular, when one of the deformed potshell walls is being straightened, not to adversely affect the potshell wall lying opposite in each case.

This object is achieved, according to the invention, by means of straightening equipment having the features of Claim 1. Advantageous refinements of the invention are specified in the subclaims.

The straightening equipment according to the invention is capable of mechanically straightening deformed sidewalls of an approximately rectangular electrolysis potshell, as seen in a top view, in a comparatively short repair time in a directed manner in all the necessary places, specifically in that first the deformed potshell carrying structure and then the deformed potshell sheeting are straightened. The straightening equipment has an elongate straightening beam which with its length can extend over the distance, amounting to several meters, between the two long potshell sidewalls lying opposite one another, because the long sidewalls are at particularly risk in terms of deformation, such as outward bends.

This straightening beam has, at each of its two end regions, a straightening jaw which has in each case a U-profile-shaped through-orifice open to the jaw underside. With the aid of movable lifting equipment, the straightening beam can be positioned with its two straightening jaws, with their U-profile-shaped through orifices, onto the top side of two potshell sidewalls lying opposite one another in each case. In or on the U-legs of the straightening jaws is arranged in each case at least one hydraulic straightening ram which comes to lie parallel to the potshell bottom and approximately perpendicularly to the potshell sidewall and serves as a straightening tool, that is to say the straightening beam has, overall, at least four straightening rams which lie along a line of action parallel to the potshell bottom and which, during the positioning of the straightening beam, are first in the retracted state and initially do not yet come into contact with the top sides of the potshell sidewalls or with the top side of the potshell carrying structure.

In the operating position of the straightening equipment, a centring unit arranged centrally between the two straightening jaws and connected fixedly to the straightening beam is seated on the bottom of the potshell to be straightened, and the centring unit is to prevent the straightening equipment according to the invention from slipping out of place in the potshell to be straightened. The straightening of the outwardly pressed sidewalls of the potshell carrying structure is commenced first. The at least four straightening rams lying along a line of action operate as follows:

While one straightening jaw, by the corresponding outer straightening ram being extended, is performing, by applying the straightening force, the straightening work on a potshell wall to be straightened, in the case of the other straightening jaw both the outer and the inner straightening ram are extended, that is to say the other straightening jaw is firmly braced, in the manner of a tongue-like holding claw, with the top side of the opposite potshell sidewall and serves as a captively fixed counterbearing.

To ensure that the straightening equipment according to the invention is spread absolutely reliably into the potshell to be straightened, pivotable centring levers are articulated at the bottom on the centring unit arranged between the straightening jaws, on the sides facing the potshell sidewalls to be straightened, and, after the centring unit has been placed onto the potshell bottom, can be spread into the lower corner regions between the potshell bottom and potshell sidewalls, as a result of which, via the spread-in centring levers, a positive connection is made between the potshell to be straightened and the straightening equipment according to the invention.

When the straightening equipment according to the invention is in use, the risk is avoided where, during the straightening of one potshell side with a correction of its skew position, the other potshell side is adversely affected. To be precise, the other potshell side may have a completely different deformation resistance or, for example, it is not or is no longer deformed and it then to that extent requires no further correction. By means of the equipment according to the invention, therefore, different deformations of all the sidewalls of an electrolysis potshell can be corrected completely independently of one another. In simple terms: in spite of the straightening work on one potshell wall, the opposite wall is not unwantedly deformed. Time losses due to restraightening work are avoided.

After the deformed carrying structure of the electrolysis potshell has been straightened by means of the straightening equipment according to the invention, the deformed potshell sheeting is straightened, as is explained further below.

Figure 2:
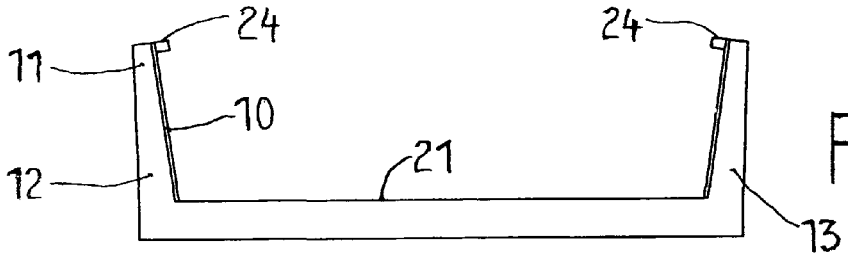
Figure 3:
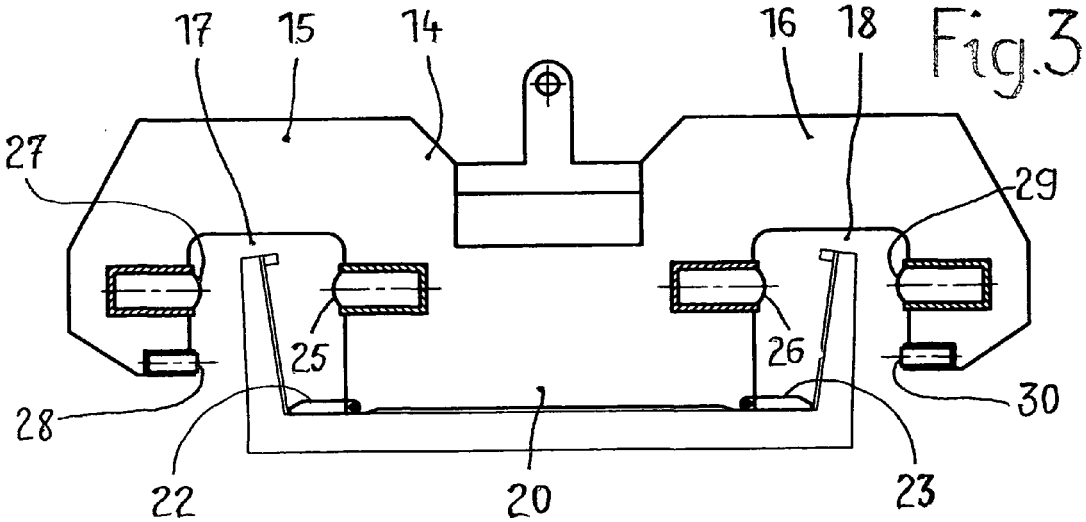
Figure 4:
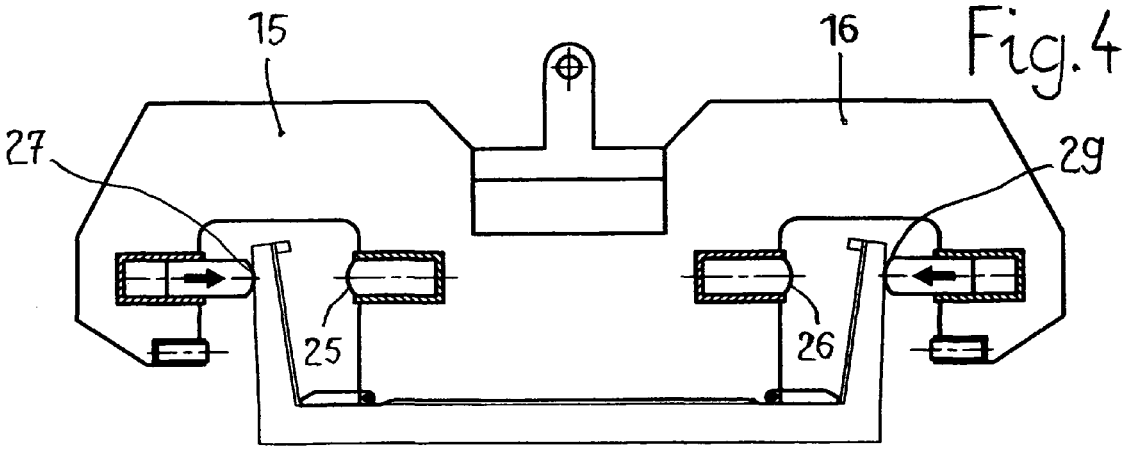
Figure 5:
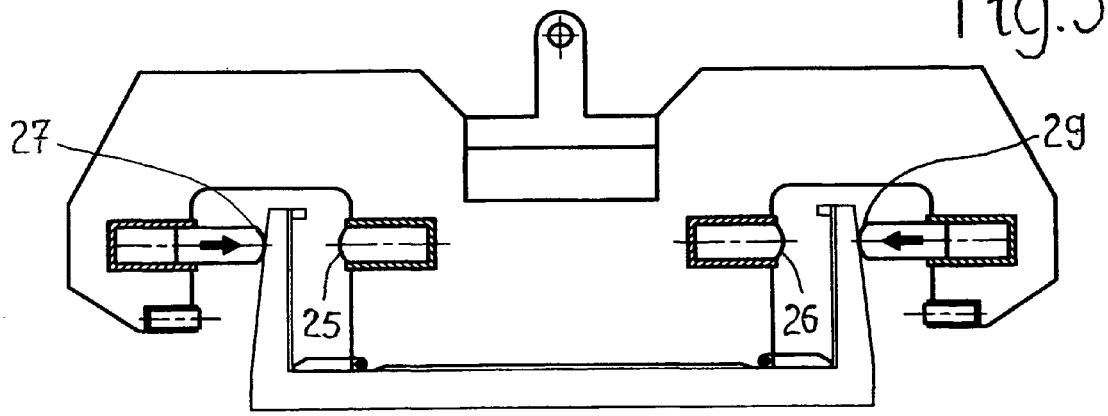

The invention and its further features and advantages are explained in more detail with reference to the exemplary embodiments illustrated diagrammatically in the figures in which:

FIG. 1 shows a side view of the straightening equipment according to the invention shortly before its use in an electrolysis potshell having deformed sidewalls, FIG. 2 shows diagrammatically, in cross section, an empty electrolysis potshell with outwardly bent sidewalls, FIG. 3 to FIG. 12 show the straightening equipment of FIG. 1 in different working positions.

FIG. 2 shows the electrolysis potshell to be straightened, with its potshell sheeting 10 which is stiffened by means of an external carrying structure having robust vertical webs 11 spaced apart from one another and tapering upwards. In spite of the stiffening webs 11, during the operation of the electrolytic cell, the potshell sidewalls 12, 13, together with the webs 11, have been pressed obliquely outwards from their originally vertical inner wall position. The purpose of the straightening equipment according to the invention is to bring the inner wall of the potshell sidewalls 12, 13 into its originally vertical position again, as can then be seen in FIG. 5, FIGS. 8 and 9 and FIG. 12.

Explained first with reference to FIG. 1, the straightening equipment has an elongate rigid straightening beam 14 which may consist, for example, of a hollow-box steel structure and which has at each of its two end regions a straightening jaw 15, 16 which in each case has a U-profile-shaped through orifice 17, 18 open to the jaw underside. By means of these through orifices 17, 18 of the straightening jaws, the straightening beam 14 can be positioned onto the top side of the two potshell sidewalls 12, 13. For this purpose, the straightening beam 14 is suspended, by means of a member 19 attached centrally to the top side, on a movable lifting appliance and is lowered downwards by the latter in the direction of the top sides of the potshell sidewalls 12, 13.

A centring unit 20 is arranged on the underside of the straightening beam 14 in the middle region between the two straightening jaws 15, 16 and is seated on the bottom 21 of the potshell in the working position of the straightening equipment (FIGS. 3 to 12). Articulated on the bottom of the centring unit 20 are pivotable centring levers 22, 23 which can be spread into the lower corner regions between the potshell bottom 21 and potshell sidewalls 12, 13.

As may be gathered clearly from FIG. 2 to FIG. 12, the inside of the walls 12, 13 of an electrolysis potshell often have on the top side a peripheral inwardly projecting collar 24 which, however, does not obstruct the lowering of the straightening equipment according to the invention with its centring unit 20, because, during the lowering procedure, the articulated centring levers 22, 23 pivot downwards under the action of gravity and thus make it possible to slip the centring unit 20 in between potshell walls 12, 13 lying opposite one another, and the horizontal spreading position of the centring levers occurs only by the underside of the centring unit 20 being placed onto the bottom 21 of the potshell.

In the U-legs of the straightening jaws 15, 16 surrounding the top side of the potshell walls 12, 13 are arranged, overall, six hydraulic straightening rams which come to lie parallel to the potshell bottom 21 and approximately perpendicularly to the potshell sidewall and of which the upper four straightening rams and the lower two straightening rams lie in each case along a line of action. Thus, as becomes clearly apparent from FIG. 1 and FIGS. 3 to 12, in each case an inner straightening ram 25, 26 is arranged in the inner U-legs of the two straightening jaws 15, 16, while in each case two outer press cylinders 27, 28 and 29, 30 are arranged in the outer U-legs of the straightening jaws, that is to say, overall, six straightening rams are present. In this case, on the in each two outer straightening rams, the larger straightening ram 27 or 29 can be pressed onto the less easily bendable outer stiffening webs 11 of the electrolysis potshell and the smaller straightening ram 28 or 30 can be pressed onto the potshell sheeting lying between adjacent webs 11.

As will become apparent, furthermore, from FIG. 1 and FIGS. 3 to 12, the two outer straightening rams 27, 28 and 29, 30 are arranged one above the other, specifically the larger straightening ram 27 or 29 is in the higher position and the smaller straightening ram 28 or 30 is in the lower position. During the straightening of the deformed potshell, by the larger straightening rams 27 and 29 being actuated, first the more bend-resistant webs 11 of the carrying structure are straightened, after which the straightening equipment is shifted laterally with its straightening beam 14, in order then to straighten the potshell sheeting by the actuation of the smaller straightening rams 28 and 30.

FIGS. 3 to 10 illustrate various operating states of the straightening equipment during the straightening of the potshell carrying structure. In the operating state according to FIG. 3, first, all the straightening rams, that is to say both the inner straightening rams 25, 26 and the outer straightening rams 27, 29 are retracted. According to FIG. 4, the outer straightening rams 27, 29 are extended (black arrows) and they commence the work of bending back the bent-out potshell carrying-structure webs. Should the deformation resistances by chance be of equal amount on both potshell sides during straightening, the two potshell walls are straightened uniformly to their desired position (vertical inner wall) until a signal occurs. The straightened potshell state can be seen in FIG. 5.

Figure 6:
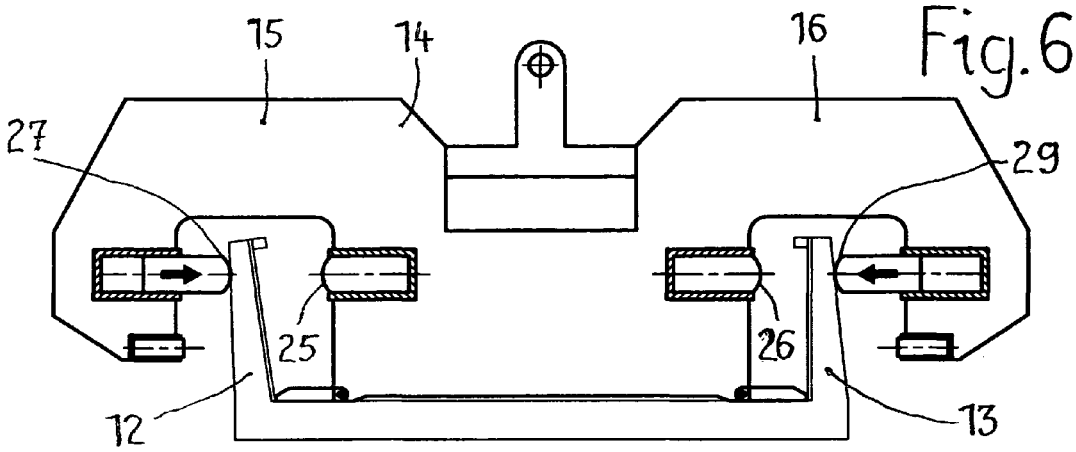

FIG. 6 illustrates the state in which the resistance during straightening at the left-hand straightening ram 27 is greater than at the right-hand straightening ram 29, that is to say, during straightening, the more stable the more deformation resistant left-hand potshell wall 12 remains in its position, whereas the right-hand potshell wall 13 can be straightened into its desired position until a signal occurs.

Figure 7:
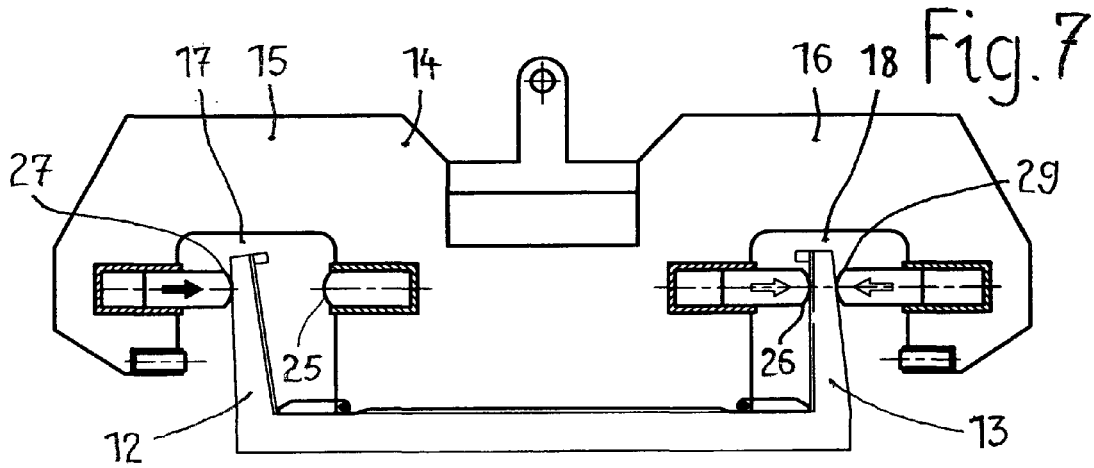
Figure 8:
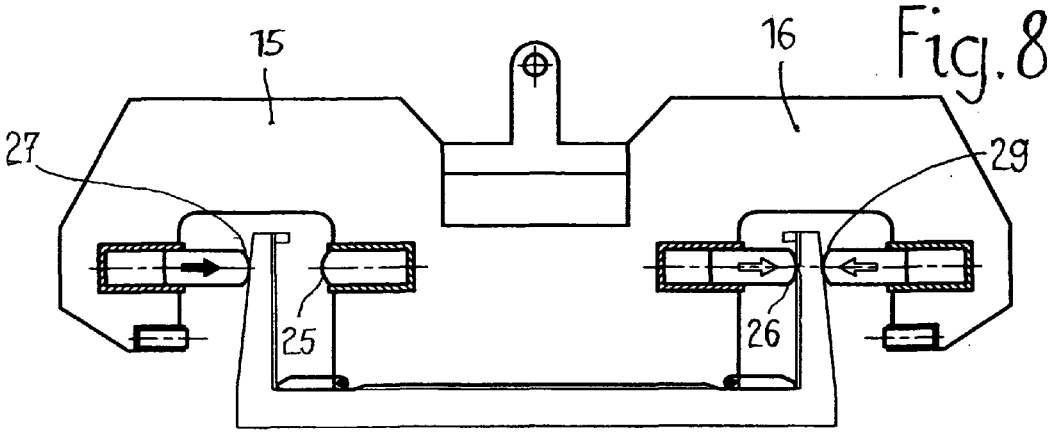

The straightening of the deformed left-hand potshell wall 12 which has still remained according to FIG. 6 then takes place, according to FIG. 7, as follows: the two outer straightening rams 27 and 29 are in abutment on the outside against the potshell stiffening webs, the straightening ram 29 serving as a stay. The right-hand inner straightening ram 26 is extended until it is likewise in engagement as a stay. The left-hand outer straightening ram 27 is then extended and straightens the left-hand potshell wall 12 into its desired position, once again until a signal occurs. When this straightening work is being carried out on the left-hand potshell wall, the opposite (right-hand) straightening jaw 16 is firmly braced, in the manner of a tongue-like holding claw, with the top side of the right-hand potshell sidewall 13 or with its carrying structure and serves as a captively fixed counterbearing. The end result is that, according to FIGS. 8 and 9, the two potshell walls of different deformation resistance have been straightened successively, without influencing one another, into their correct position in a directed manner.

Figure 10:
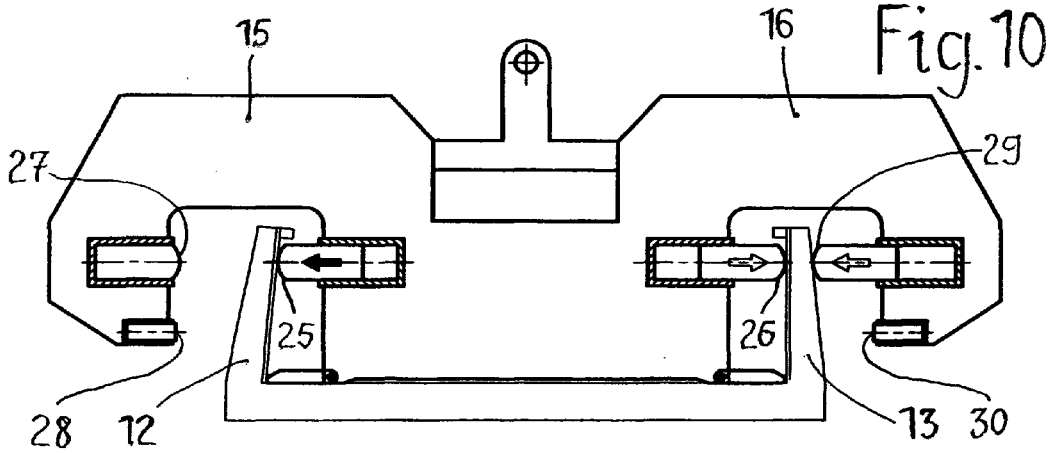

It will be appreciated that, by means of the straightening equipment according to the invention, even those defects on electrolysis potshells can be corrected in which one or more of the potshell sidewalls do not have to be bent back from the outside inwards, but, conversely, from the inside outwards, also caused, as the case may be, by the overstretching of a sidewall when straightening work is being carried out. FIG. 10 illustrates the corresponding straightening of the in this case overstretched left-hand potshell wall 12 by the straightening ram 25 being extended.

Figure 9:
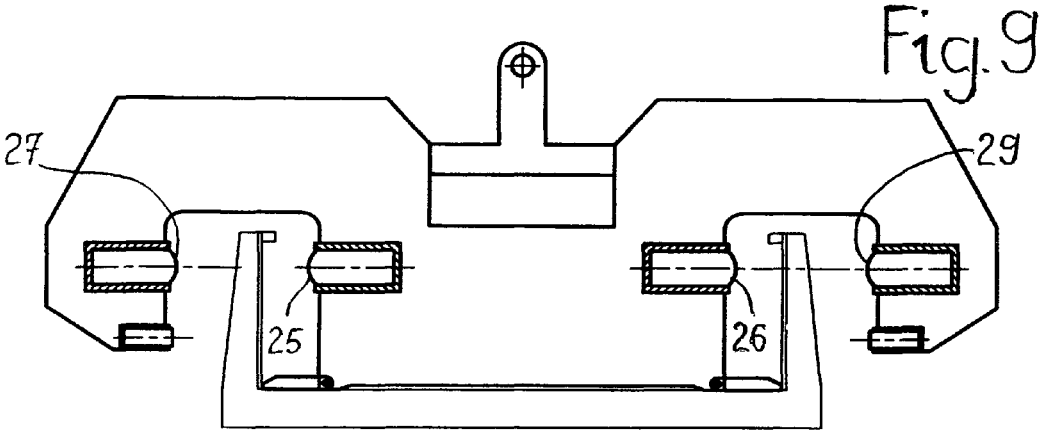
Figure 11:
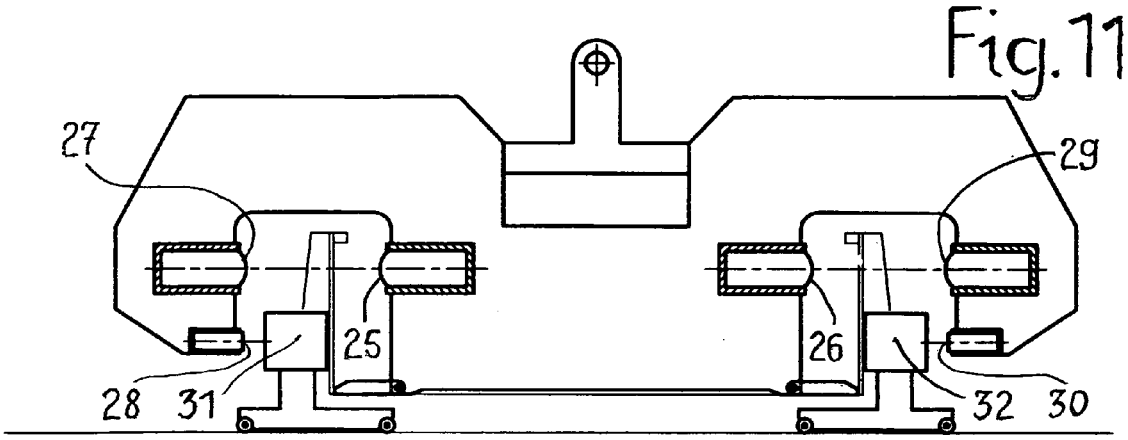
Figure 12:
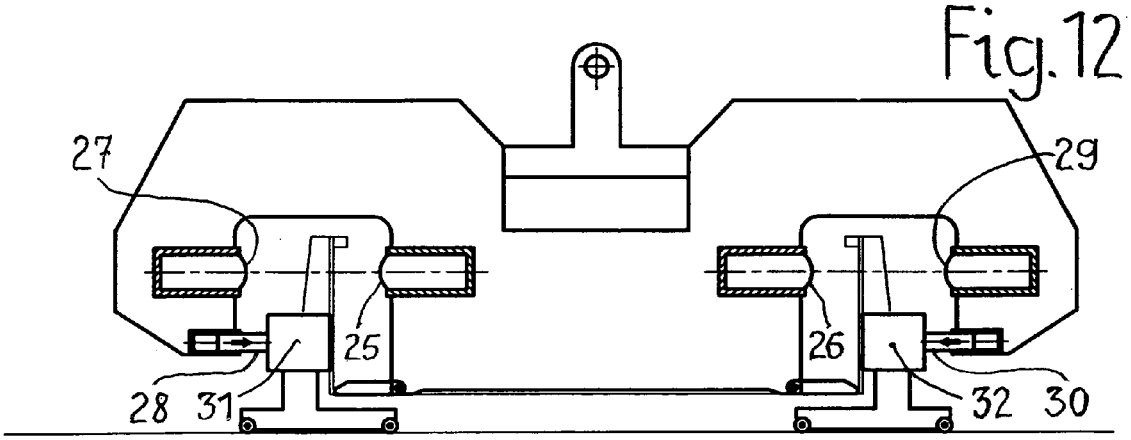

After the potshell carrying structure has been straightened, which state can be seen in FIG. 9, the straightening equipment, together with the retracted straightening rams, is shifted laterally somewhat, using the lifting device present, so that the potshell sheeting lying between the carrying-structure webs can be straightened. This operating state is illustrated in FIGS. 11 and 12. FIG. 12 shows how the two straightening rams 28 and 30 lying in a lower position on a line of action are extended and, with movable pressure plates 31 and 32 interposed, press from outside onto the potshell sheeting and straighten the latter.

The invention claimed is:

1. Equipment for straightening of deformed electrolysis potshells, for aluminium molten-bath electrolysis, with an elongate transportable and displaceable straightening beam (14) extending over a distance between at least two opposite long sidewalls (12, 13) of a potshell and which has at each of two end regions of the beam a straightening jaw (15, 16) with a downwardly open U-profile-shaped through orifice (17, 18), the two straightening jaws being capable of being positioned with each respective through orifices onto a top side of the potshell sidewalls (12, 13) lying opposite one another, in the working position of the straightening equipment a centring unit (20) connected to the straightening beam (14) being seated on the bottom of the potshell to be straightened, wherein:

a) in or on U-legs of the straightening jaws (15, 16) is arranged in each case at least one hydraulic straightening ram (25, 26, 27, 29) coming to lie parallel to the potshell bottom (21) and approximately perpendicularly to the potshell sidewall (12, 13) and serving as a straightening tool, such that at least four straightening rams lie along a line of action parallel to the potshell bottom; and b) while one straightening jaw (15), by the corresponding straightening ram (27) being extended, is applying a straightening force, on the potshell sidewall (12), the other straightening jaw (16) is firmly braced with both the outer and the inner straightening ram (29, 26) extended, and with the top side of the opposite potshell sidewall (13) acting as a captively fixed counterbearing.

2. Equipment according to claim 1, wherein pivotable centring levers (22, 23) are articulated at the bottom on the centring unit (20) on the sides facing the potshell sidewalls to be straightened and, after the centring unit (20) has been placed onto the potshell bottom (21), can be spread into the lower corner regions between the potshell bottom and potshell sidewalls.

3. Equipment according to claim 1, wherein each of the inner straightening ram (25, 26) is arranged in the inner U-legs of the two straightening jaws (15, 16), while each of the outer straightening rams (27, 28 and 29, 30) are arranged in the outer U-legs of the straightening jaws (15, 16), such that at least six straightening rams are present.

4. Equipment according to claim 3, wherein, in each of the outer straightening rams there is a larger straightening ram and a smaller straightening ram, wherein the larger straightening ram (27 or 29) can be pressed onto outer stiffening webs (11) of the electrolysis potshell carrying structure and the smaller straightening ram (28 or 30) can be pressed onto the potshell sheeting lying between adjacent webs (11).

5. Equipment according to claim 4, wherein the two outer straightening rams (27, 28 and 29, 30) in or on the outer U-legs of the two straightening jaws (15, 16) are arranged one above the other, specifically the larger straightening ram (27 or 29) is in the higher position and the smaller straightening ram (28 or 30) is in the lower position.

6. Equipment according to claim 5, wherein, lying between adjacent carrying-structure webs (11), and attached by means of the straightening rams (28, 30) located in the lower position, are fitted-in pressure plates (31, 32) movable between the straightening rams and the potshell sheetings.

7. Equipment according to claim 1, wherein the straightening beam (14), with its two straightening jaws (15, 16), consists of a hollow-box steel structure.

8. Equipment according to claim 1, wherein the straightening beam (14) has on its top side, at the centre, a member (19) for suspending the straightening beam on a lifting appliance.

9. Equipment according to claim 7, wherein the straightening beam (14) has on its top side, at the centre, a member (19) for suspending the straightening beam on a lifting appliance.

* * * * *